US006540021B1

(12) United States Patent
Botrel

(10) Patent No.: US 6,540,021 B1
(45) Date of Patent: Apr. 1, 2003

(54) METHOD FOR DETECTING INFLOW OF FLUID IN A WELL WHILE DRILLING AND IMPLEMENTING DEVICE

(75) Inventor: Thierry Botrel, Pau (FR)

(73) Assignee: Elf Exploration Production, Courbevoie (FR)

( * ) Notice: Subject to any disclaimer, the term of this patent is extended or adjusted under 35 U.S.C. 154(b) by 0 days.

(21) Appl. No.: 09/869,034

(22) PCT Filed: Dec. 23, 1999

(86) PCT No.: PCT/FR99/03267

§ 371 (c)(1),
(2), (4) Date: Sep. 10, 2001

(87) PCT Pub. No.: WO00/39433

PCT Pub. Date: Jul. 6, 2000

(30) Foreign Application Priority Data

Dec. 23, 1998 (FR) ..... 98 16363

(51) Int. Cl.[7] ..... E21B 47/00

(52) U.S. Cl. ..... 166/250.08; 166/64; 166/264; 73/152.33

(58) Field of Search ..... 166/250.01, 250.03, 166/250.08, 264, 302, 64, 66; 73/152.19, 152.33

(56) References Cited

U.S. PATENT DOCUMENTS 5,661,236 A * 8/1997 Thompson

* cited by examiner

*Primary Examiner*—Roger Schoeppel
(74) *Attorney, Agent, or Firm*—Sughrue Mion, PLLC

(57) ABSTRACT

A method for detecting inflow of fluid in a well while drilling, wherein the drilling is carried out using an installation including a hollow cylindrical drill string (3) wherein is injected fresh mud, a tubing (5) defining with the drill string (3) an annular space (7) through which the loaded mud rises; it involves continuously measuring a heat flow; then continuously calculating on the basis of the quantity the value of a characteristic representing a thermal equilibrium obtained in the absence of a fluid occurrence formation; and detecting variations in the characteristic, the variations representing a thermal imbalance, resulting from inflow of fluid in the well (1). The invention is particular by applicable in operating oil drilling installations particularly deep at sea.

16 Claims, 2 Drawing Sheets

METHOD FOR DETECTING INFLOW OF FLUID IN A WELL WHILE DRILLING AND IMPLEMENTING DEVICE

TECHNICAL DOMAIN

The present invention concerns a detection process of formation fluid invasions in a well during drilling, as well as a device for the implementation of this process.

It finds application specifically in onshore of offshore oil drilling rigs.

PRIOR STATE OF THE ART

Formation fluid invasions and specifically gaseous hydrocarbons in a borehole that occur during drilling or operations are phenomena that need to be detected as early as possible in order to facilitate their control and to minimize their consequences as uncontrolled eruptions can cause fires, pollution, the destabilization or the loss of the well.

The need to detect invasions early intensified with the development of borehole drilling in more and more difficult conditions, such as those encountered in drilling boreholes at high pressure and high temperatures, as well as in the drilling deep-sea boreholes in very great water depths.

Classically, a rig comprises a hollow cylindrical drill string arranged inside a casing, provided at its lower end with a drill bit and coupled at its upper part to a rotary drive device.

For offshore drilling, the rig includes in addition a pipe riser that joins the upper part of the surface conductor to surface equipment. During the drilling the fresh mud stored in tanks is injected inside the drill string by a mud pump.

After passage through the drill bit the mud injected inside the drill string is charged with rock cuttings formed by the action of the drill bit on the formation, and rises in the annular space defined on the one hand by the drill string and the casing extended by the pipe riser and on the other hand the borehole wall during the course of drilling, it then returns in storage pits after the elimination of cuttings.

A recognized method of detection of fluid invasions in the borehole during drilling consists in measuring the difference between the flow of fresh mud injected and the flow of charged mud that rises, to compare this difference then to a predetermined threshold. The exceeding of this threshold means a fluid invasion.

This flow difference is generally determined indirectly starting from the measurement of the mud level in storage pits, corrected for known additions of fluids to the mud, such as chemicals, and the mud volume variations in the borehole linked to tripping of equipment.

This determination is also affected by the loss of circulation in a part of the formation that can conceal or delay the difference variation between the fresh mud flow and the charged mud flow resulting from fluid invasions in the borehole, which difference is the basis of the detection.

The accuracy of such a determination, therefore, is very mediocre and insufficient to detect fluid invasions in boreholes efficiently and early.

In the case of drilling in very great water depths this precision is even worse, because of movements of the floating marine platform that carries the drilling facilities and because of the cyclic fluctuations of the pipe riser volume due to the heaving of the platform. This poor precision is even more bothersome in this case, where the formation fracture pressure at the fragile point of the borehole, decreases the maximum admissible volume of a fluid invasion without the risk of losing the well.

Another detection method of a formation fluid invasion is described in the document U.S. Pat. No. 4,733,232 dated Mar. 22, 1982. It consists in modulating the drilling flow close to bottom hole and comparing pressure impulses that are reflected at the time in the drill string and in the annular space. The ratio of the reflected impulse is modified by an invasion of gas that change the density of the mud that rises in the annular space, this modification is detected by a computer and is used as an alarm signal.

Another method of detection of a formation fluid invasion is described in the document EP 621 397 dated Jun. 25, 1991. It consists in analyzing vibrations emitted in the mud at the inlet of the drill string and vibrations sensed in the upper part of the annular space. These latter vibrations result from the propagation inside the drill string and in the annular space, of the vibrations emitted, and are affected by fluctuations of mud characteristics that change with formation fluid invasions in the borehole. The comparison by means of a vibration analyzer of the vibrations emitted and those sensed permit the detection of formation fluid invasions.

These last two methods are sensitive to cuttings entrained by the mud rising in the annular space and can in certain cases become inoperative due to the significance of reflection of the vibrations from the rock formation particles that constitute the cuttings.

In addition, their implementation requires the use of costly equipment.

STATEMENT OF THE INVENTION

The present invention has precisely as its object the remedying of these inconveniences and specifically to provide a process and a device for early detection of a formation fluid invasion in a borehole during drilling.

This process and this device may be used for the detection of fluid invasions in the form of liquid or gaseous hydrocarbons, or water, during the course of drillings both onshore and offshore, this detection permits taking counter measures to stop the development of these invasions or to minimize their effects.

For this end, the present invention proposes a detection process of a formation fluid invasion in a borehole during drilling, said drilling consisting of executing a borehole in a formation, by means of a rig including a hollow cylindrical drill string, arranged inside a casing, and into which string is injected fresh mud, said drill string, said casing and the borehole wall in the course of execution define an annular space through which the charged mud rises, which process is characterized in that it consists of:

- measuring continuously the thermal flux circulating between the fresh mud and the charged mud through the wall of the drill string, at a given depth,
- calculating continuously starting from said thermal flux, the value of a representative characteristic of a thermal balance as established in the absence of a formation fluid invasion, between the fresh mud circulating inside the drill string and the charged mud rising in the annular space, and
- detecting fluctuations greater than a threshold, of the value of said characteristic, said fluctuations translate into a disruption of said thermal balance resulting from invasions of formation fluid in the borehole.

According to another characteristic of the invention the representative characteristic of the thermal balance is the speed of fluctuation of the thermal flux circulating between the fresh mud and the charged mud through the wall of the drill string, at a given depth.

According to another characteristic of the invention the representative characteristic of the thermal balance is the difference between the instantaneous value and a moving time window average value of the thermal flux circulating between the fresh mud and the charged mud through the wall of the drill string, at a given depth.

The drilling rig being operated from a command control system, according to another characteristic, the present invention proposes a process that consists in addition, in case of detecting a fluctuation of the characteristic, greater than a threshold, of transmitting a signal indicative of said detection to said system so that it generates an alarm.

The present invention also has as its object a detection device of a formation fluid invasion in a borehole during drilling, said drilling consisting of executing a hole in a formation by means of a drill rig comprising a hollow cylindrical drill string, arranged inside a casing and into which string is injected the fresh mud, said drill string, said casing and the borehole wall of the hole in progress define an annular space through which the charged mud rises, which device is characterized in that it includes;

at least one measurement sensor of the thermal flux circulating between the fresh mud and the charged mud through the drill string wall, at a given depth, sensor that provides a measurement signal of the said thermal flux on an output, the calculation means connected to the output of said sensor, to calculate starting from the thermal flux measured, the value of a representative characteristic of thermal balance as established in the absence of a formation fluid invasion, between the fresh mud circulating inside the drill string and the charged mud rising in the annular space, and processing means, connected to an output of the calculation means, to:

detect fluctuations in the value of the said characteristic, greater than a threshold, said fluctuations translating into a disruption of said thermal balance resulting from a formation fluid invasion in the borehole, and deliver a signal indicative of a fluid invasion on an output.

According to another characteristic of the invention device, the representative characteristic of the thermal balance is the speed of variation of the thermal flux circulating between the fresh mud and the charged mud through the drill string wall, at a given depth.

According to another characteristic of the invention device the representative characteristic of the thermal balance is the difference between the instantaneous value and a moving time window average value of the thermal flux circulating between the fresh mud and the charged mud through the drill string wall, at a given depth.

According to another characteristic of the device of the invention, the rig operated from a command control system, said device includes the transmission means connected to the outlet of processing means, to transmit the signal indicative of a fluid invasion to said system, so that said system generates an alarm.

The present invention also has for its object a second process of detection of a formation fluid invasion in a sub-sea borehole during drilling, said drilling being realized by means of a drill rig including a cylindrical hollow drill string, arranged inside a casing extended by a riser pipe stretching in the water between the sea floor and the sea surface, some fresh mud being injected into said drill string that forms with said casing and said pipe riser an annular space through which the charged mud rises, which process is characterized in that it consists of:

measuring continuously the thermal flux circulating between the charged mud and the sea water through the wall of the riser pipe, at a given depth, calculating continuously starting from the measured thermal flux, the value of a representative characteristic of a thermal balance as established in the absence of a formation fluid invasion, between the sea water and the charged mud rising in the annular space, and detecting variations greater than a threshold, of the value of the said characteristic, said variations translating into a disruption of the said thermal balance resulting from invasions of formation fluid in the borehole.

According to another characteristic of the second process of the invention, the characteristic representative of the thermal balance is the speed of fluctuation of the thermal flux circulating between the charged mud and the sea water through the wall of the pipe riser, at a given depth.

According to another characteristic of the second process of the invention, the representative characteristic of the thermal balance is the difference between the instantaneous value and a moving time window average value of the thermal flux circulating between the charged mud and the sea water through the wall of the pipe riser, at a given depth.

The invention also has as its object a second detection device of a formation fluid invasion in a sub-sea borehole during drilling, said drilling being realized by means of a drilling rig including a hollow cylindrical drill string, arranged inside a casing extended by a pipe riser stretching in the water between the sea bottom and the sea surface, of the fresh mud being injected in said drill string that forms with said casing and said pipe riser an annular space through which the charged mud rises, which device is characterized in that it includes at least one measurement sensor representative of a physical magnitude of the drilling operation, that provides a measurement signal of physical magnitude on an output, calculation means, connected to the output of the sensor of a physical magnitude, to calculate from said physical magnitude, the value of a representative characteristic of a thermal balance as established, in the absence of a formation fluid invasion, between the sea water and the charged mud rising in the annular space, and processing means, connected to an output of calculation means, to:

detect variations of the value of the said characteristic, greater than a threshold, said variations translate into a disruption of the said thermal balance resulting from a formation fluid invasion in the borehole, and deliver a signal indicative of a fluid invasion on an output.

According to another characteristic of the second device of the invention, the representative characteristic of the thermal balance is the speed of fluctuation of the measured thermal flux.

According to another characteristic of the second device of the invention, the representative characteristic of the thermal balance is the difference between the instantaneous value and the moving average value of the measured thermal flux.

According to another characteristic of the second device of the invention the rig is operated from a command control system, it comprises the transmission means connected to the output of the processing means, to transmit to said system the signal indicative of a fluid invasion, so that said system generates an alarm.

BRIEF DESCRIPTION OF DRAWINGS

The invention will be better understood with the help of the following description of a method of realization given by way of example, in reference to attached drawings in which.

DETAILED STATEMENT OF THE INVENTION

Figure 1:
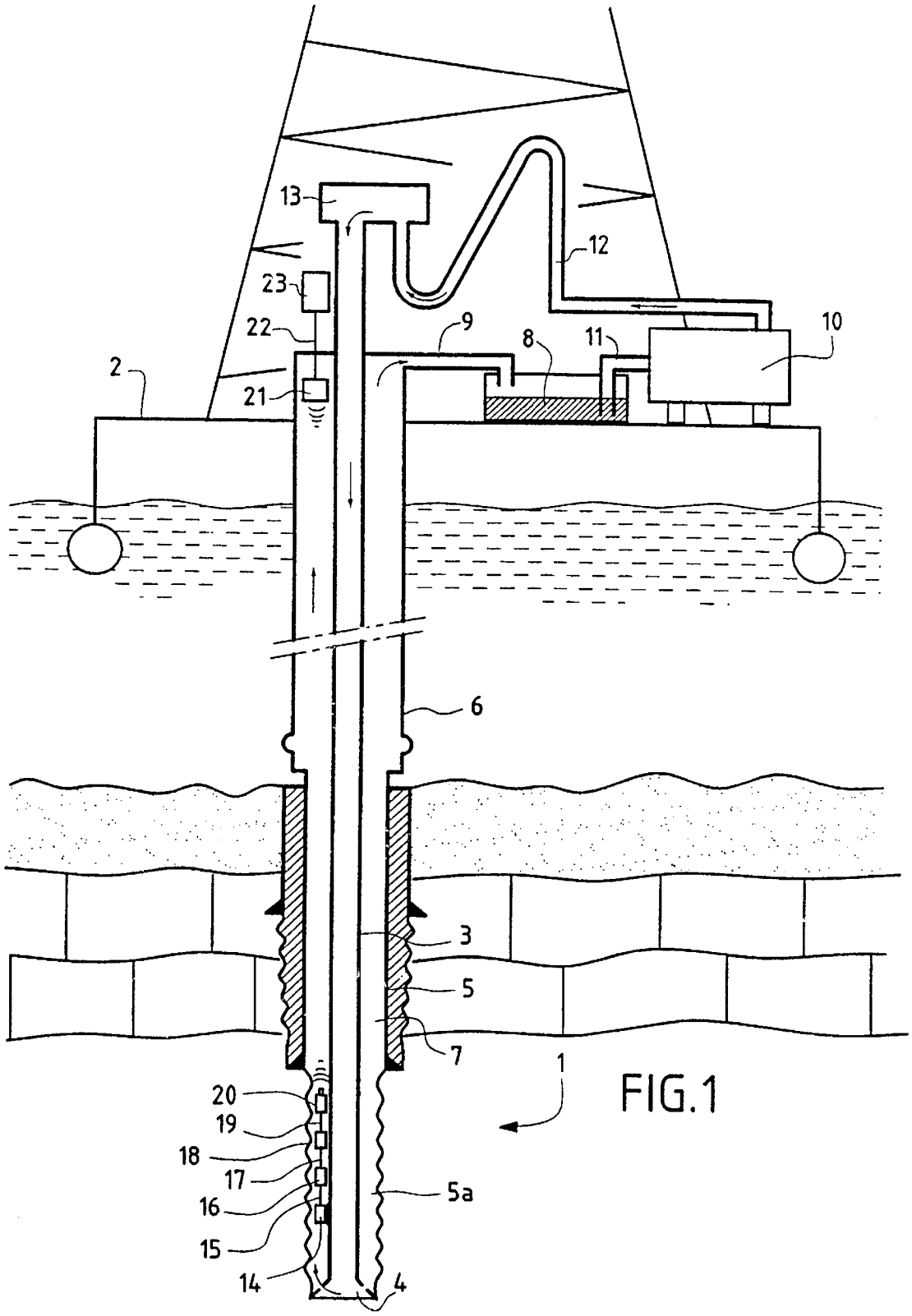
FIG. 1 represents schematically an oil drilling rig in deep water equipped with a detection device of formation fluid invasion according to the description of the invention.

FIG. 1 represents a sub-sea oil and gas borehole 1 during drilling, realized by means of a rig that includes, a floating platform 2 that supports a drill string 3, constituted of cylindrical tubes screwed end to end, provided at its lower end with a drilling tool 4 and its upper part with an straight swivel 13. The drill string 3 is driven in rotation by a means not represented on FIG. 1, mounted on the platform 2.

A mud pump 10 sucks in the fresh mud stored in a tank 8 through an intake pipe 11 and discharges this mud into the straight swivel 13.

The borehole during drilling includes a casing 5 extended at its upper part by a riser pipe 6 and at its bottom part by the borehole wall 5*a* of the hole in execution. The extended casing 5 surrounds the drill string 3 to form an annular space 7 the upper part of which is connected by a piping 9 to the tank 8.

The fresh mud compressed by the pump 10 in the straight swivel 13 is injected inside the drill string 3 in which it circulates from top to bottom and through the drilling tool 4 is charged with cuttings, then rises in the annular space 7 and returns by the piping 9 into the storage tank 8.

The detection device of a formation fluid invasion in the borehole 1 according to a preferential method of realization of the invention represented in FIG. 1, includes a measurement sensor 14 of thermal flux mounted against the external wall of the drill string 3 in the bottom part of the annular space 7 at 10 meters above the drilling tool 4.

The sensor 14 delivers a representative signal on an output 15 of the thermal flux that flows between the fresh mud and the charged mud through the internal and external wall of the drill string, at its mounting point. The thermal flux measured by the sensor 14 is the quantity of heat exchanged by the charged mud that circulates in the annular space 7, with the fresh mud injected inside the drill string 3, by means of the said drill string, per unit time and per unit surface of the external drill string 3 wall it is expressed for example in Watts per cm2.

The charged mud that rises in the annular space 7 since it has been in contact with the drilled formation, has a different temperature from the fresh mud that descends inside the drill string 3.

Because of this temperature difference a thermal flux circulates between the two muds, radially through the drill string.

When drilling conditions, specifically the flow, the composition, the temperature of the injected mud, pressure head losses of the mud circuit do not vary, a thermal balance is established in the absence of fluid invasion in the borehole. This thermal balance results specifically in an essentially constant difference, between the temperature of the fresh mud that circulates inside the drill string and the temperature of the charged mud. The measured thermal flux, that results from this temperature difference is therefore also essentially constant.

An invasion of formation fluid, produces the following effects:

- a significant variation of the thermal heat-conductivity of the mud that rises in the annular space, because the mud and the formation fluid have different thermal conductivities, particularly in the case of gas invasions,
- a variation of conditions of flow of the charged mud, because the mud and the formation fluid have different densities and viscosities and, in the case of gas invasions, because of a possible expansion of this gas,
- a variation of the mud temperature that rises through the annular space, because the formation fluid that is mixed with the mud has a different temperature from this latter.

These variations have as a consequence a rapid modification of heat exchange conditions between the mud that circulates inside the drill string and the mud that rises in the annular space, that results in a disruption of the thermal balance established prior to the invasion of the formation fluid.

This disruption causes a variation of the thermal flux measured by means of the sensor 14.

The output 15 from the sensor 14 is connected to an input for the calculation means 16 of the speed of variation of the thermal flux measured by the sensor 14 that delivers a representative signal of the deviation to an output 17 with respect to the time of the measured thermal flux.

The output 17 is connected to an input of the processing means 18 that performs the following operations:

- compare, after filtering, the signal delivered by the calculation means 16, representative of the deviation with regard to the time of the measured thermal flux, at a predetermined negative threshold and,
- in the case of exceeding said threshold delivers a signal on an output 19.

As has been indicated above, in the absence of invasions of formation fluid the thermal flux measured by the sensor 14 is essentially constant, its drift with regard to the time is therefore very low.

When a formation fluid invasion occurs in the borehole, the thermal flux measured by the sensor 14 varies and its deviation with regard to the time becomes strongly negative and exceeds the value of the predetermined threshold.

The filtering of the signal delivered by the means 16 prior to the comparison is a classic operation that has the purpose of eliminating the insignificant variations of fluid invasions.

In the same way, the transient threshold crossings that do not signify formation fluid invasions are not taken in account.

The value of the threshold is determined on site according to drilling conditions such as the thermal gradient, the kind of fluids, the depth, the borehole diameter, the circulation flow rate of the drilling fluid.

The signal delivered at the output 19 of the processing means 18 is therefore indicative of a formation fluid invasion in the borehole.

The output 19 of the processing means is connected to an input of a transmission means including a transmitter module 20 placed close to the sensor 14 and a receiver module 21 placed at the upper part of the annular space 7.

The module 21 delivers on an output 22 a reproduced signal of the signal delivered on the output 19 by processing means 18.

A rig command control system 23, connected to the output 22 of the receiver module 21, generates an alarm in the form of a message displayed on an operating console to warn of a fluid invasion in the borehole, for a rig operator, who will operate the safety preventers not represented in FIG. 1.

The command control system 23 can act also on the rig for example by manipulating its emergency shutdown devices to limit the effects of the fluid invasion that have been detected.

A variant of the invention consists in transmitting the signal delivered by sensor 14, by the transmission means appropriate to the calculations means and processing means installed on the platform.

The sensor 14, calculation means, processing means and the transmission means may be mounted to good advantage on a sleeve that will fit between the two tubes of the drill string.

This sleeve can simultaneously hold a customary measurement system for other parameters during drilling such as pressure, the borehole inclination, the weight on bit.

A variant of the invention realization method described above consists in mounting two formation fluid invasion detection devices on the outside wall of the drill string at different depths and measuring the time interval between the fluid invasion detection by each of the two devices.

The interval so measured gives an indication on the nature of the invasion. Effectively, a gas invasion propagates more quickly than a liquid invasion, the time interval measured in the first case will be shorter than the one measured in the second.

Figure 2:
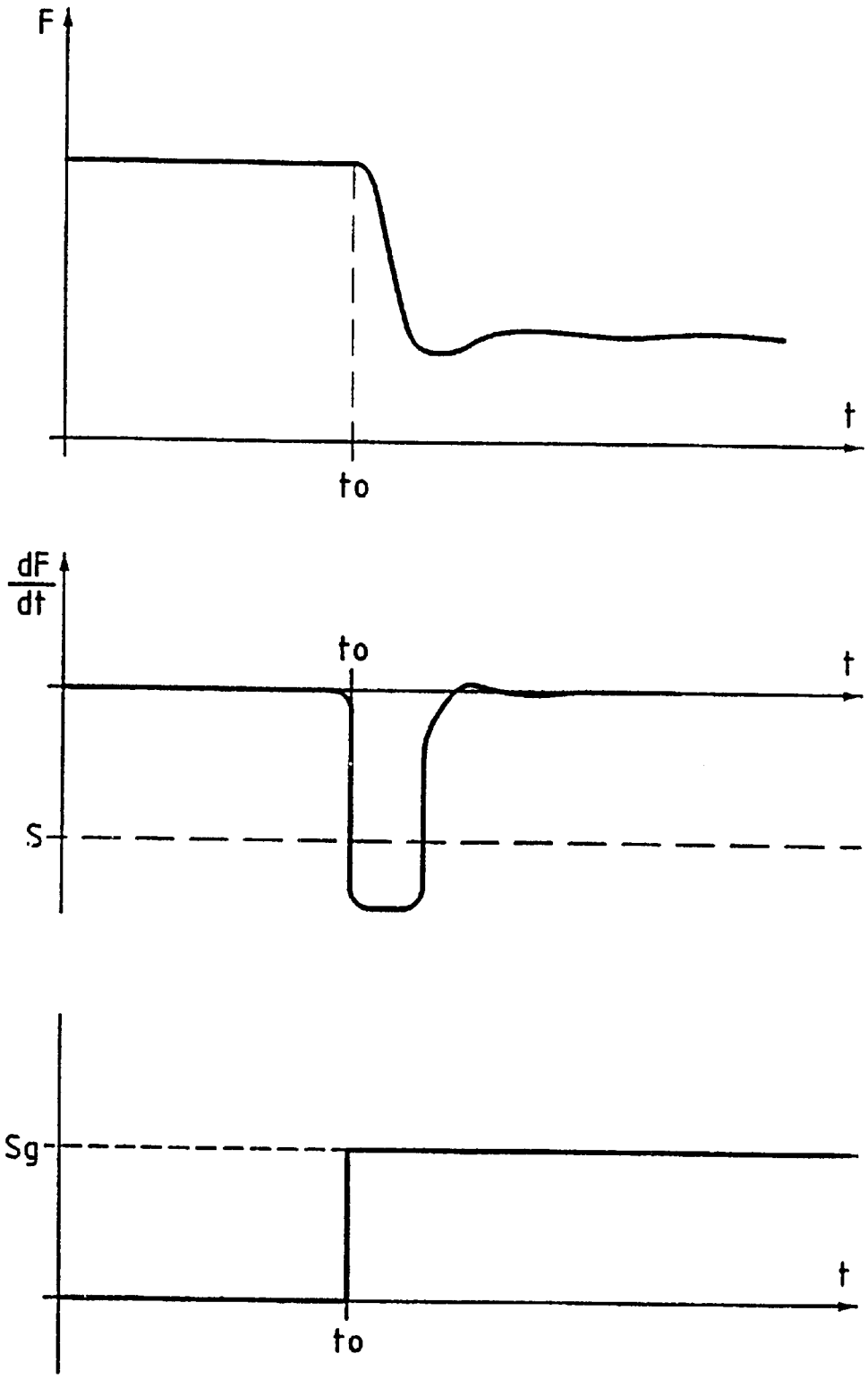
FIG. 2 is a timing diagram of essential signals occurring in the device of FIG. 1.

FIG. 2 represents a timing diagram of the main signals occurring in the invention device represented in FIG. 1.

F represents the evolution of the thermal flux measured by means of sensor 14 as a function of time, a fluid invasion in the borehole appearing at the instant to.

dF/dT represents the speed of variation of the thermal flux measured as a function of the time, S is the predetermined threshold value which on surpassing the same, permits detecting a fluid invasion.

Sg represents the signal delivered by means of processing, indicative of a fluid invasion in the borehole.

Due to the invention it is possible to detect a formation fluid invasion early in a borehole during drilling in the form of gaseous and/or liquid hydrocarbons, and/or water without risk of delay or its masking by a loss of circulation in the formation and also at the least cost.

In the case of sub-sea borehole drilling the invention method and the device are, in addition, insensitive to movements of the platform and the volume changes of the pipe riser, and in all cases to the presence of cuttings in the charged mud.

What is claimed is:

1. A process for detecting a formation fluid invasion in a borehole (1) during drilling, said drilling comprising creating a borehole in a formation, by means of a rig including a cylindrical hollow drill string (3), arranged inside a casing (5) and into which fresh mud is injected, said drill string, said casing and a borehole wall **(5*a*) defining an annular space (7)** through which charged mud rises, said process comprising the steps of:

a) continuously measuring thermal flux circulating between the fresh mud and the charged mud through a wall of the drill string, at a given depth, b) continuously calculating, starting from said thermal flux, a value of a representative characteristic of a thermal balance established in the absence of a formation fluid invasion, between the fresh mud circulating inside the drill string and the charged mud rising in the annular space, and c) detecting variations of the value of said characteristic greater than a threshold said variations indicating a disruption of said thermal balance resulting from formation fluid invasions in the borehole.

2. Process according to claim 1, wherein the representative characteristic of thermal balance is a speed of variation of the thermal flux circulating between the fresh mud and the charged mud through the wall of the drill string.

3. Process according to claim 1, wherein the representative characteristic of thermal balance is a difference between an instantaneous value and a moving time window average value of the thermal flux circulating between the fresh mud and the charged mud through the wall of the drill string.

4. Process according to claim 1, wherein the rig, operated from a command control system, in case of detection of a variation of the representative characteristic of the thermal balance greater than said threshold, transmits to said system a representative signal of said detection so that it generates an alarm.

5. A device for detecting a formation fluid invasion in a borehole (1) during drilling, said drilling comprising creating a borehole in a formation by means of a rig including a cylindrical hollow drill string (3), arranged inside a casing (5) and into which fresh mud is injected, said drill string, said casing and a borehole wall (5a) defining an annular space (7) through which charged mud rises, said device comprising:

a) at least one sensor for measuring a thermal flux circulating between the fresh mud and the charged mud through a wall of the drill string, at a given depth, said sensor providing a measurement signal of said thermal flux as an output, b) calculation means connected to the output of said sensor for calculating, starting from the thermal flux measured, a representative characteristic of a thermal balance established in the absence of a formation fluid invasion, between the fresh mud circulating inside the drill string and the charged mud rising in the annular space, and c) processing means, connected to an output of the calculation means, for:

i) detecting variations of said characteristic, greater than a threshold, said variations indicating a disruption of said thermal balance resulting from a formation fluid invasion in the borehole, and ii) delivering an output signal indicative of a fluid invasion.

6. Device according to claim 5 wherein the representative characteristic of the thermal balance is a speed of variation of the thermal flux circulating between the fresh mud and the charged mud through the drill string wall.

7. Device according to claim 5 wherein the representative characteristic of thermal balance is a difference between an instantaneous value and a moving time window average value of the thermal flux circulating between the fresh mud and the charged mud through the drill string wall.

8. Device according to claim 5, wherein the rig, operated from a command control system, includes transmitting means connected to the processing means output, for transmitting the signal indicative of a fluid invasion to said system, so that said system generates an alarm.

9. A process for detecting a formation fluid invasion in a sub-sea borehole (1) during drilling, said drilling being implemented by means of a rig including a cylindrical hollow drill string (3), arranged inside a casing (5) and a riser pipe (6) extending in water between the sea floor and the sea surface, fresh mud being injected in said drill string, which forms with said casing and said riser pipe an annular space (7) through which charged mud rises, which process comprises the steps of:

a) continuously measuring thermal flux circulating between the charged mud and the sea water through a wall of the riser pipe, at a given depth, b) continuously calculating from the measured thermal flux, a value of a representative characteristic of a thermal balance established in the absence of a formation fluid invasion, between the sea water and the charged mud rising in the annular space, and c) detecting variations of the value of said characteristic greater than a threshold, said variations indicating a disruption of said thermal balance resulting from formation fluid invasions in the borehole.

10. Process according to claim 9, wherein the representative characteristic of thermal balance is a speed of variation of the thermal flux circulating between the charged mud and the sea water through the wall of the riser pipe.

11. Process according to claim 9, wherein the representative characteristic of thermal balance is a difference between an instantaneous value and a moving time window average value of the thermal flux circulating between the charged mud and the sea water through the wall of the pipe riser.

12. Process according to claim 9, wherein the rig, operated from a command control system, in case of detection of a variation of the representative characteristic of the thermal balance greater than said threshold, transmits to said system a representative signal of said detection so that it generates an alarm.

13. A device for detecting a formation fluid invasion in a sub-sea borehole (1) during drilling, said drilling being implemented by means of a rig including a cylindrical hollow drill string (3), arranged inside of a casing (5) and a riser pipe extending in water between the sea floor and the sea surface, fresh mud being injected in said drill string, which forms with said casing and said riser pipe an annular space (7) through which charged mud rises, said device comprising:

a) at least one sensor for measuring a thermal flux circulating between the charged mud and the sea water through a wall of the riser pipe, at a given depth, said sensor providing a measurement signal of said thermal flux as an output, b) calculation means connected to the output of said sensor for calculating, from the measured thermal flux, a representative characteristic of a thermal balance established in the absence of a formation fluid invasion, between the charged mud rising in the annular space and the sea water through the wall of the riser pipe, at a given depth, and c) processing means, connected to an output of the calculation means for:

i) detecting variations of said characteristic, greater than a threshold, said variations indicating a disruption of said thermal balance resulting from a formation fluid invasion in the borehole, and ii) delivering an output signal indicative of a fluid invasion.

14. Device according to claim 13, wherein the representative characteristic of thermal balance is a speed of variation of the measured thermal flux.

15. Device according to claim 13, wherein the representative characteristic of thermal balance is a difference between an instantaneous value and a moving average value of the measured thermal flux.

16. Device according to claim 13, wherein the rig, operated from a command control system, includes transmitting means connected to the output of the processing means, for transmitting to said system the signal indicative of a fluid invasion, so that said system generates an alarm.

* * * * *